United States Patent [19]

Cremasco

[11] Patent Number: 4,529,327

[45] Date of Patent: Jul. 16, 1985

[54] TYPEWRITER CORRECTION DEVICE FOR CORRECTING IN THE FORWARD OR REVERSE DIRECTIONS

[75] Inventor: Venanzio M. Cremasco, Banchette, Italy

[73] Assignee: Ing. C. Olivetti & C., S.p.A., Ivrea, Italy

[21] Appl. No.: 299,187

[22] Filed: Sep. 2, 1981

[30] Foreign Application Priority Data

Sep. 4, 1980 [IT] Italy ..... 68365 A/80

[51] Int. Cl.[3] ..... B41J 33/22

[52] U.S. Cl. ..... 400/697.1; 400/214; 400/248; 400/311

[58] Field of Search ..... 400/211, 215, 216.1, 400/216.5, 214, 248, 248.1, 248.2, 668, 696, 697, 697.1, 274, 275, 276, 276.2, 671.2, 671.4, 672.2, 678

[56] References Cited

U.S. PATENT DOCUMENTS

| | | | |
|---|---|---|---|
| 1,183,424 | 5/1916 | Baldwin | 400/696 |
| 2,919,781 | 1/1960 | Rix et al. | 400/672.2 X |
| 3,149,711 | 9/1964 | Wolowitz | 400/697.1 |
| 3,154,183 | 10/1964 | Wolowitz | 400/697.1 |
| 3,664,478 | 5/1972 | Menicanti et al. | 400/668 |
| 3,799,316 | 3/1974 | Davidge et al. | 400/697.1 |
| 3,882,990 | 5/1975 | Genesio | 400/697.1 |
| 3,934,697 | 1/1976 | Kuramochi | 400/274 X |
| 4,119,385 | 10/1978 | Watanabe et al. | 400/216.1 X |
| 4,247,210 | 1/1981 | Kacmarcik et al. | 400/236.1 |

FOREIGN PATENT DOCUMENTS

| | | | |
|---|---|---|---|
| 0038215 | 10/1981 | European Pat. Off. | 400/697.1 |
| 482752 | 9/1929 | Fed. Rep. of Germany | 400/274 |
| 2057976 | 4/1981 | United Kingdom | 400/697.1 |

*Primary Examiner*—Ernest T. Wright, Jr.

*Attorney, Agent, or Firm*—Banner, Birch, McKie & Beckett

[57] ABSTRACT

An erasing ribbon is guided by the same vibrator as the typing ribbon behind the lower part of the typing ribbon. An erasing key acts on the back-spacing mechanism of the typewriter and on an element which suppresses the carriage escapement during a correction cycle initiated by any one of the typing keys. The necessary settings are made by a slide which stores the erasing key command. In particular, the slide acts on a lever which varies the stroke of the ribbon vibrator for selecting the erasing ribbon, also on a device which causes the erasing ribbon to advance and on a mechanism which inhibits the escapement during the execution of the correction cycle. The setting slide is then returned to rest by the first typing key operated after the erasing cycle. A correction selection lever acts on the lever which varies the stroke of the ribbon vibrator and selects permanently the erasing ribbon independently of the erasing key for a forward erasing of the characters of one or more words.

2 Claims, 11 Drawing Figures

TYPEWRITER CORRECTION DEVICE FOR CORRECTING IN THE FORWARD OR REVERSE DIRECTIONS

BACKGROUND OF THE INVENTION

This invention relates to a correction device for typewriters comprising a typing ribbon, a vibrator and an element which can be set in order to effect a stroke variation of the vibrator.

A correcting device is known, fitted to a typewriter in which the typing ribbon is of the two-colour type, the upper part being constituted by a normal typing ribbon and the lower part constituted by an erasing ribbon. This device has the drawback of using only one half of the height of the typing ribbon. The maximum typing capacity is therefore reduced. Moreover, because the typing ribbon is reversed many times in order to obtain optimum utilisation, an already used portion of erasing ribbon which has no further erasing capability can become located in front of the character to be erased.

Other correction devices fitted to typewriters are known, which however require the use of numerous components and considerable modifications to the structure of a typewriter not having the erasing function, because of which machines provided with this device are very costly.

SUMMARY OF THE INVENTION

An object of the invention is to provide a correction device which is of simple, safe and reliable operation, and which can be fitted to typewriters which do not possess such a device at low cost.

Another object of the invention is to provide correction selection means for selecting either a backward correction mode wherein a previous backspacing of the printing point is required to erase or cover each erroneous character or a forward corection mode wherein the erroneous characters are erased or covered jointly with forward movements of the printing point.

DESCRIPTION OF THE DRAWING

The invention will be described in more detail, by way of example, with reference to the accompanying drawing, in which.

DESCRIPTION OF THE ILLUSTRATED EMBODIMENT

The erasing device 16 (FIG. 1), is fitted in this case by way of example to an Olivetti electric hammer typewriter commercially known as "Lettera 36". The various devices already existing in the typewriter are therefore described and represented herein only in summary form.

Figure 1:
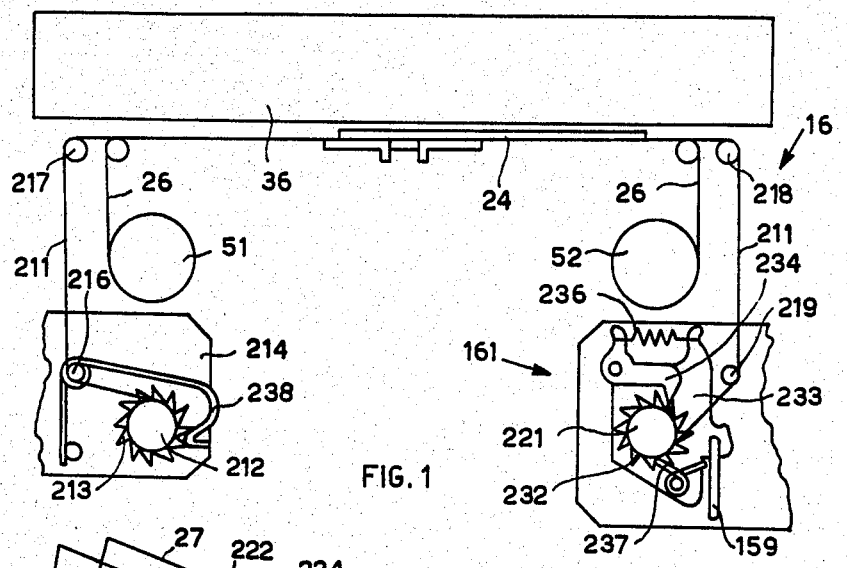
FIG. 1 is a partial diagrammatic view of a correction device embodying the invention fitted to a typewriter.

The device 17 for raising the typewriter typing ribbon 26 (FIG. 2) comprises a cam 18 which is rotated in known manner about a shaft 20 at each typing cycle and, by means of a cam follower lever 19, fulcrumed on a pin 25, releases a rocker arm 21. A spring 22 rotates the rocker arm 21 clockwise, and by means of a tie rod 23 rotates a ribbon raising lever 24, about a pin 30, clockwise in order to position a typing ribbon 26 at the point of typing. The typing ribbon 26 is a normal double track single colour ribbon or a two-colour ribbon constituted for example by a black upper part 27 and a red lower part 28. The ribbon 26 is normally housed and guided in a fork 29 of the ribbon raising lever (vibrator) 24, which comprises at one end the fork 29 and at the other end a tongue 31 arranged to cooperate with a selection lever 32. The selection lever 32 comprises two shoulders 33 and 34 arranged to cooperate selectively with the tongue 31 to determine the smaller or larger stroke of the ribbon raising lever 24 respectively. This corresponds to the positioning of the lower or upper track of the single-colour ribbon or, respectively, the black part 27 or red part 28 of the ribbon 26 in front of the platen 36 (FIG. 1). The selection lever 32 (FIG. 2) also comprises a tongue 37 arranged to cooperate with the lower end of the rocker arm 21 in order to halt its stroke and thus not position the typing ribbon 26 in front of the platen 36 (FIG. 1), thus determining the third or neutral position.

By means of a tongue 41 of a bar 42, a selector 38 (FIG. 2), rotatable on a pivot 39, controls a shoulder 43 of the selection lever 32 in order to position it in one of the three positions, namely black, red or neutral. A spring 44 (FIG. 7) normally keeps the selection lever 32 rotated clockwise and halted by the shoulder 43 against the tongue 41 of the tie bar 42. The selector 38 is set manually by the operator and maintains its set position by virtue of a positioner 45 of FIG. 2. The positioner 45 comprises three slots 46, 47 and 48 for selectively housing an end 49 of a shaft 133 and a spring 50 which holds the end 49 engaged with the selected slot 46, 47 or 48.

Figure 3:
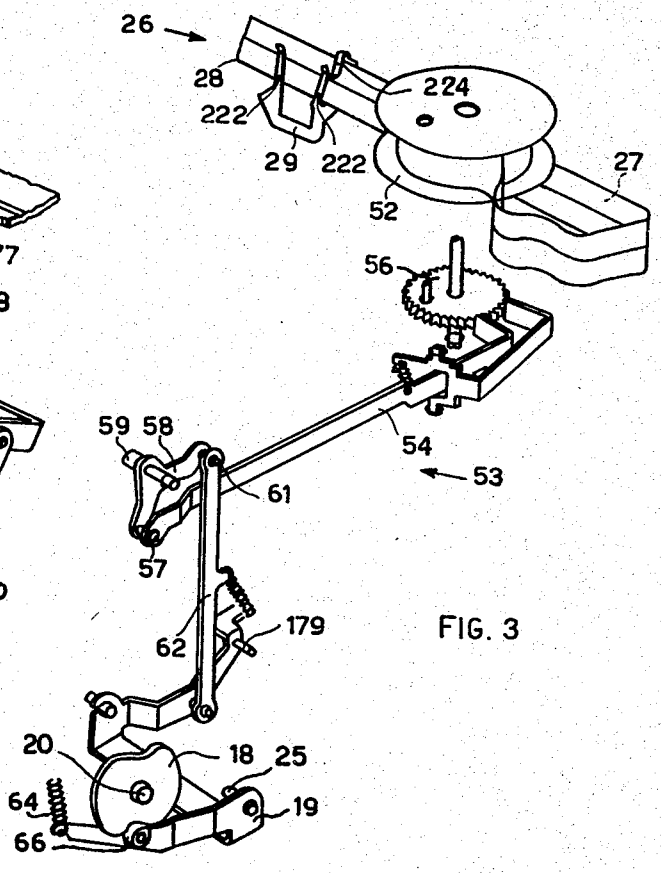
FIG. 3 is a perspective view of a second device of the typewriter of FIG. 1.

The typing ribbon 26 (FIG. 1) is normally wound on two ribbon spools 51 and 52, and advances through a certain distance at each typing cycle by means of a ribbon feed and motion reversal device 53 (FIG. 3). The device 53 is constituted by two entrainment mechanisms (only one of which is shown in the drawing), one for each spool 51, 52, these being alike and disposed in such a manner that when one mechanism acts on a spool 51, 52, the other operates idly. The device 53 comprises a pawl 54 normally engaged with a gear wheel 56 for entraining the spool 52, and is connected by a pin 57 to an angle lever 58 rotatable on a pivot 59. The lever 58 is connected by a pin 61 to a tie bar 62 which is connected in its turn to the lever 19. A spring 64 normally keeps a roller 66 of the lever 19 engaged with the cam 18. At each typing cycle, the cam 18 causes the pawl 54 to move idly through two teeth rearwards by way of the lever 19, the tie bar 62 and the lever 58, and then returns it backwards thereby rotating the gear 56 and the spool 52 through two teeth.

Figure 4:
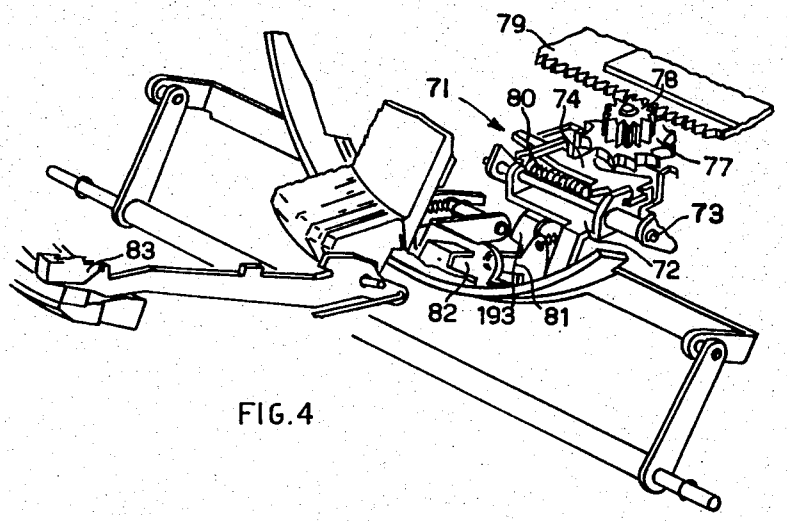
FIG. 4 is a perspective view of a third device of the typewriter of FIG. 1.
Figure 5:
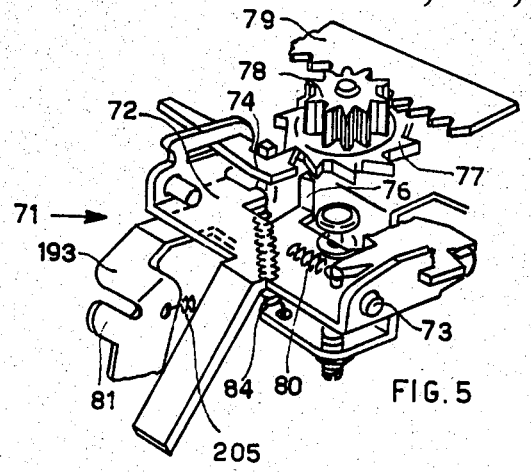
FIG. 5 is a perspective view of some details of FIG. 4.

The escapement device 71 (FIG. 5) comprises a frame 72 pivoted on a pivot 73 comprising a movable tooth 74 and a fixed tooth 76 arranged to cooperate alternately with the teeth of a ratchet wheel 77 rigid with a pinion 78 which is always engaged with a rack 79 to enable the rack 79 to move through one space towards the left at each typing cycle. The frame 72 comprises a projection 81 on which there acts a universal frame 82 (FIG. 4) which at each stroke of the hammers 83 causes the frame 72 to reciprocate in order to disengage the movable tooth 74 from the ratchet wheel 77 under the control of the fixed tooth 76 (FIG. 5). When the frame 72 is returned to rest by means of a spring 84, the movable tooth 74 is caused to re-engage, and the rack 79 is moved forwards through one space.

Figure 6:
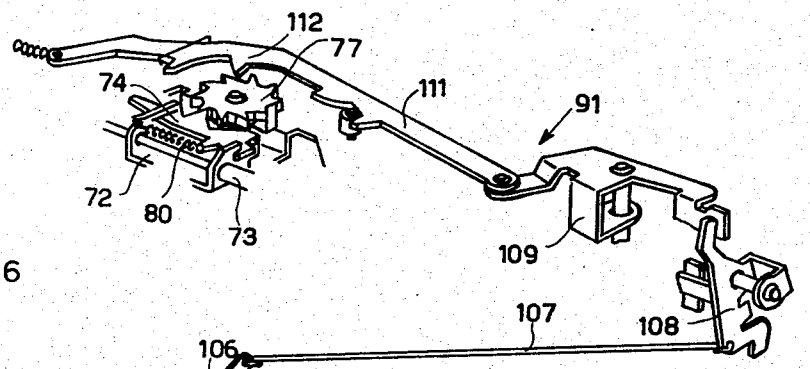
FIG. 6 is a perspective view of a fourth device of the typewriter of FIG. 1.

The back-spacing device 91 (FIG. 6), comprises a back-spacing key 92 mounted on a lever 93 fulcrumed on shaft 95. When the key 92 is depressed, the lever 93, by means of a tongue 96 of a lever 94, releases a tooth 98 from a hook 97, this tooth 98 by the action of a spring 99 becoming disposed in the trajectory of a lug 101 which rocks continuously under the action of a cam 102, by way of a lever 103 and a tie bar 104. The lug 101 engages the tooth 98 and moves it together with a lever 106, and causes a pawl 111 to slide by way of a tie rod 107 and the levers 108 and 109. As the pawl 111 slides, its tooth 112 causes the ratchet wheel 77 and pinion 78 to rotate clockwise through slightly more than one space (FIG. 5), and thus moves the rack 79 backwards through one space. The movable tooth 74 rises on the ratchet wheel 77, and under the action of a spring 80 then re-engages with the next tooth to lock the rack 79 in the position displaced backwards through one space. In addition, at the end of the cycle, the tooth 98 (FIG. 6) re-engages with the hook 97.

The erasing device 16 (FIG. 8) embodying the invention comprises a correction key 117 carried by a lever 118 which controls an intermediate lever 122 by means of a tongue 119 engaged in a slot 121. The lever 122 is fulcrumed on a shaft 125 and cooperates by means of a shoulder 123 thereof with an operating lever 124 and collaborates by means of a tongue 126 with a lug 127 of the lever 93 of the back-spacing key 92. The lever 124 (FIG. 7), pivoted on a pivot 128, is connected by a pin 129 to an operating slide 131 guided by means of a slot 132 on the shaft 133, on which the selection lever 32 is rotatable. A spring 134 keeps the slide 131 moved to the left in FIG. 7 when at rest, by holding the lever 122 raised against a fixed step 135.

Figure 2:
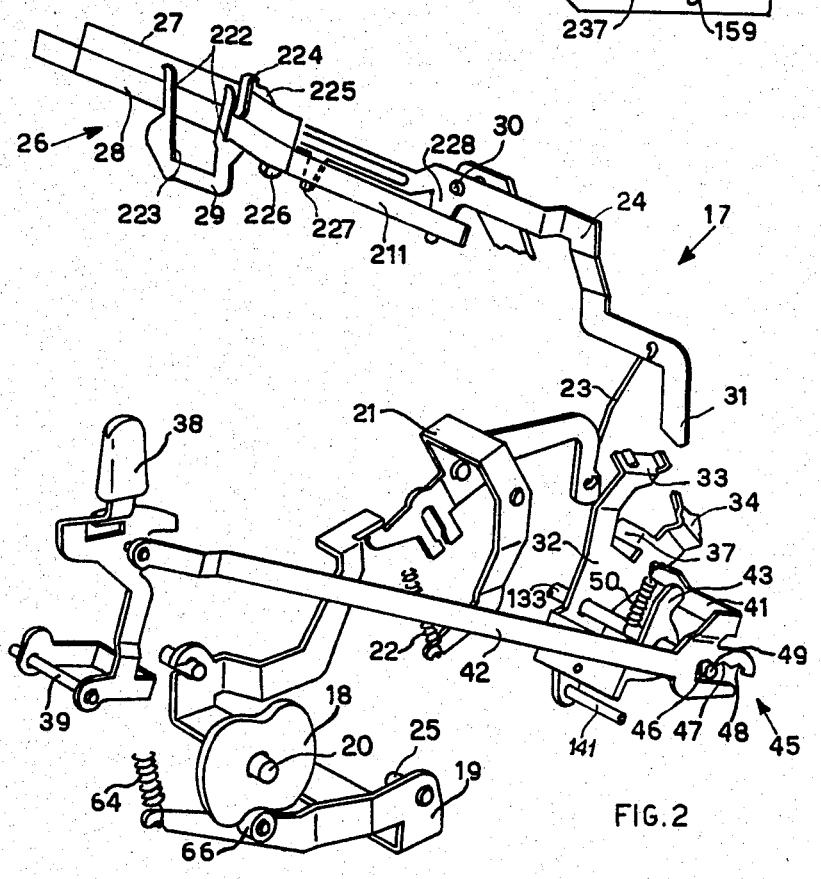
FIG. 2 is a perspective view of a device of the typewriter of FIG. 1.

The slide 131 comprises a shoulder 136 which cooperates with a pin 137 of a hook 138, and a tongue 139 arranged to cooperate with a pin 141 of the selection lever 32 of the ribbon raising device 17 (FIG. 2). The hook 138 (FIG. 7) is pivoted on a pivot 149, and is connected by a tie rod 151 and a slot 152 to the selector 38 of the ribbon raising device 17 (FIG. 2). A spring 143 (FIG. 7) fitted between the slide 131 and pin 137 normally keeps the hook 138 rotated clockwise and halted with the pin 137 against the shoulder 136. In this position, a lug 144 of the hook 138 is disposed in the trajectory of a tongue 146 of a control lever 147 pivoted on a pivot 158, and which acts by means of a tie rod 159 on a correcting ribbon feed mechanism 161 (FIG. 1).

Figure 9:
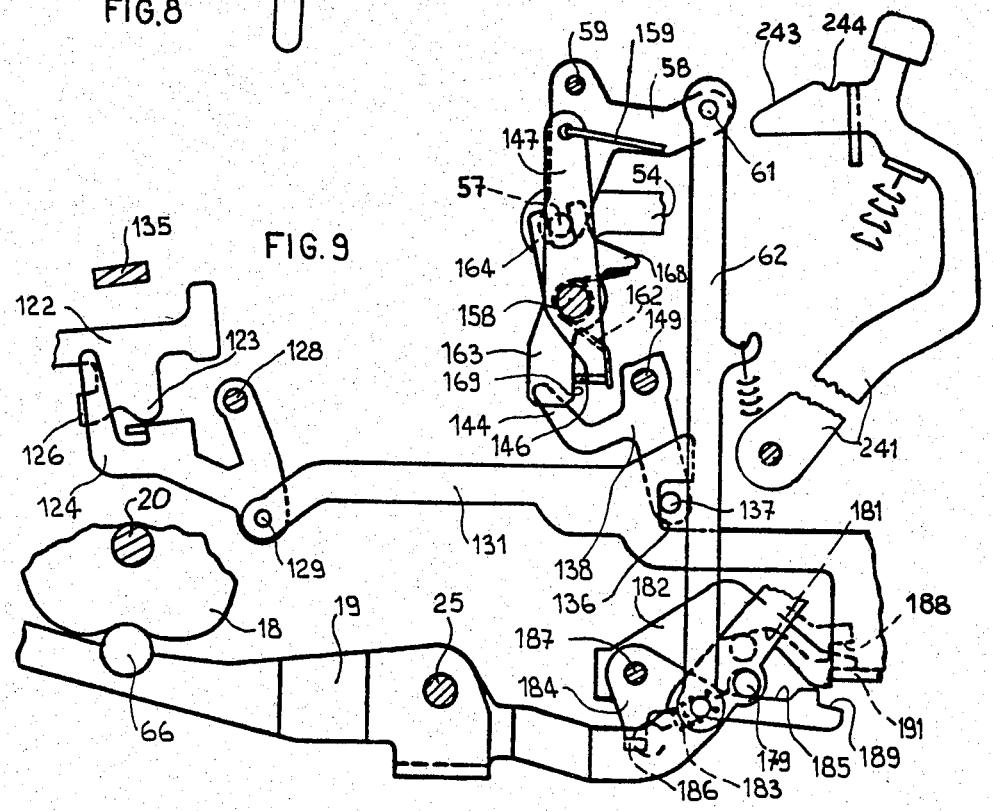
FIG. 9 is a partial longitudinal view of some details of the device of FIG. 1 in a working position.

The control lever 147 (FIG. 9) is connected by a spring 162 to a lever 163 pivoted on the pivot 158, and connected in its turn by a fork 164 to the pin 57 of the lever 58 of the device 53 (FIG. 3). The spring 162 (FIG. 9) is pivoted on the pivot 158 and is fitted between the edge of the control lever 147 and a tongue 168 of the lever 163, in such a manner as to keep the control lever 147 rotated clockwise and halted by the tongue 146 against a shoulder 169 of the lever 163.

The cam follower lever 19 comprises a pin 179 arranged to cooperate in a working stage with a shoulder 181 (FIG. 7) of a first control lever 182, and by means of a spring 183 (FIG. 9) with a second control lever 184. The spring 183 is fitted between the pin 179 and a lug 186 of the second control lever 184, and normally keeps the lever 184 halted with a shoulder 185 against the pin 179. The two control levers 182 and 184 are pivoted on a pivot 187 and each comprises an L shoulder 188, 189 respectively, arranged to cooperate with a tongue 191 of the slide 131 during a working cycle as is described hereinafter. A spring 192 (FIG. 7) normally keeps the first control lever 182 engaged against the tongue 191 of the slide 131.

Figure 10:
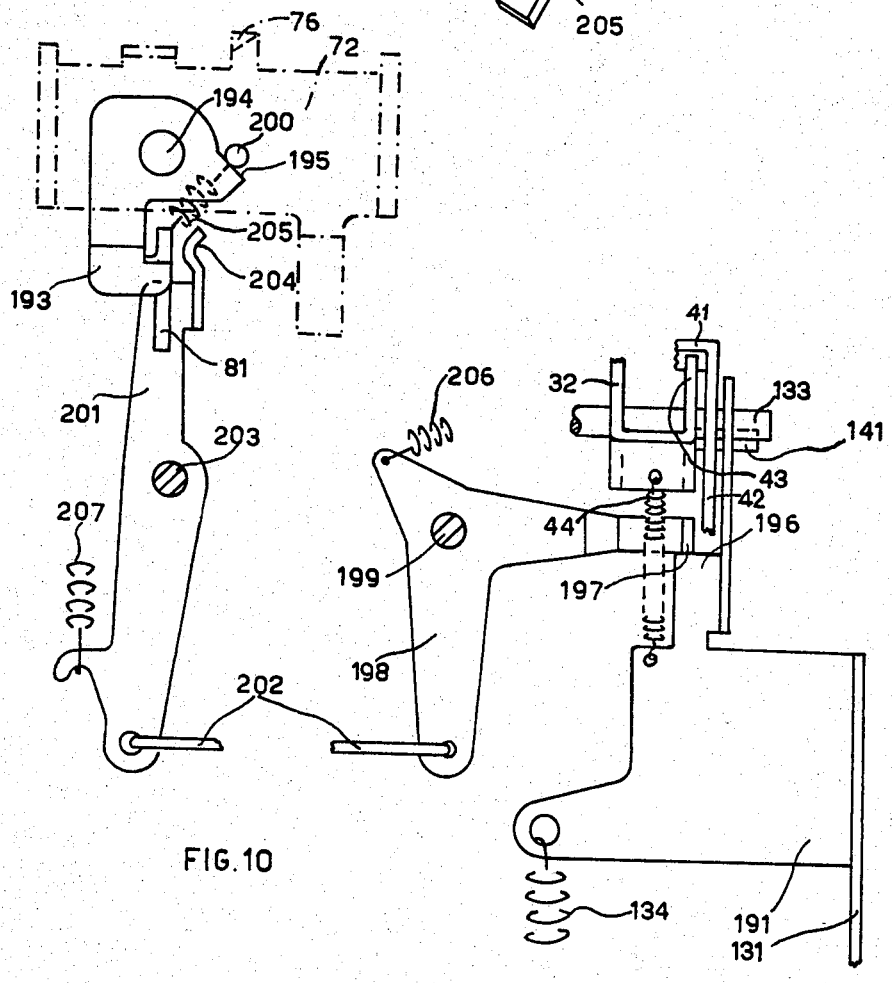
FIG. 10 is a partial plan view of some details of the device of FIG. 1 to an enlarged scale.

Finally, the slide 131 (FIG. 10) comprises a shoulder 196 arranged to cooperate with a tongue 197 of a return lever 198 pivoted on a pivot 199 and connected to a disengagement lever 201 by means of a tie rod 202. The lever 201 is pivoted on a pivot 203, and has a tongue 204 arranged to disable the escapement device 71 (FIG. 5). Thus the projection 81 (FIG. 10) is provided on a toothed lever 193 pivoted on a pin 194 of the frame 72 (represented by a dashed and dotted line) and kept normally arrested under the action of a spring 205 with its shoulder 195 against a stop 200. Two springs 206 and 207, the first fitted to the return lever 198 and the second to the disengagement lever 201, keeps the respective levers 198, 201 rotated clockwise and halted with the tongue 197 against the shoulder 196 of the slide 131.

The erasing device 16 (FIG. 1) comprises a correcting ribbon 211 wound on a feed spool 212 mounted on a toothed wheel 213 rotatable on a fixed support 214 of the typewriter. The correcting ribbon 211 unwinds from the feed spool 212, is guided by two ribbon guide pins 216 and 217, and then slides parallel to the typing ribbon 26 and to the platen 36 so that it becomes disposed together with the ribbon 26 in the fork 29 (FIG. 2) of the ribbon raising lever 24. Finally, guided by two ribbon guide pins 218 (FIG. 1) and 219, the ribbon 211 rewinds on to a take-up spool 221.

Figure 11:
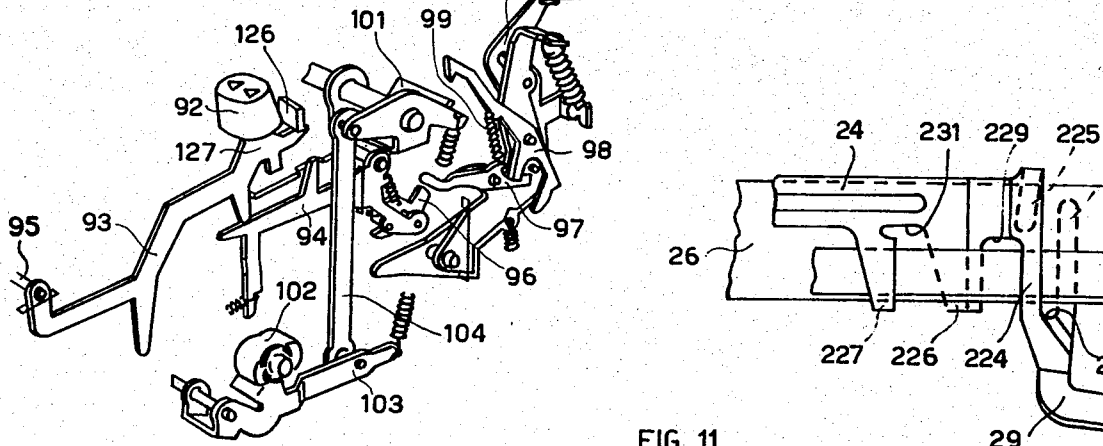
FIG. 11 is a front view of some details of FIG. 2 to an enlarged scale.
Figure 11:
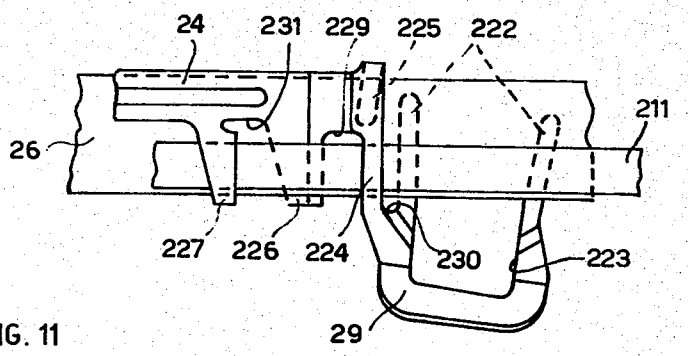

The correcting ribbon 211 is behind the typing ribbon 26, e.g. between the typing ribbon 26 and the platen 36, and has a height such as to completely cover the lower part 28 (FIG. 2) of the typing ribbon 26. If the user uses the machine with a two-colour typing ribbon 26, red typing can be obtained by inverting the two spools 51 and 52 (FIG. 1). If a single-colour typing ribbon 26 is used, inverting the spools 51 and 52 enables use to be made of the lower part 28 (FIG. 2) which has not previously been used, thus obtaining complete use of the typing ribbon 26 with consequent considerable saving. The two ribbons 26 and 211 are housed in the fork 29 which is constituted by front tongues 222 flanking a space 223 which allows passage of the hammers 83 (FIG. 4), and a rear tongue 224 (FIG. 11). The front tongues 222 hold the ribbons 26 and 211 close to the platen 36. By means of an upper bent-over portion 225, the rear tongue 224 keeps the typing ribbon 26 in position during raising and lowering. Adjacent to one tongue 224, the lever 24 guides the correcting ribbon 211 and maintains it in position after it has been used, and conveys it towards the spool 221. For this purpose, the ribbon 211 passes in behind a first tongue 226 and in front of a second tongue 227 parallel to the ribbon 26 towards a third tongue 228 (FIG. 2) and then towards the ribbon guide pins 218 (FIG. 1) and 219. The two tongues 226 (FIG. 11) and 227 form with the top of the ribbon raising lever 24 two shoulders 229 and 231 arranged to cooperate with the upper edge of the correcting ribbon 211 to prevent the ribbon 211 from rising relative to the typing ribbon 26 during the movements of the fork 29 in the typing cycles, so preventing part of the ribbon 211 from becoming disposed in front of the platen 36 (FIG. 1). The downwardly movements of the correcting ribbon 211 and the typing ribbon 26 is prevented by an inner lower edge 230 of the fork 29 defined by the tongues 222 and 224.

Figure 7:
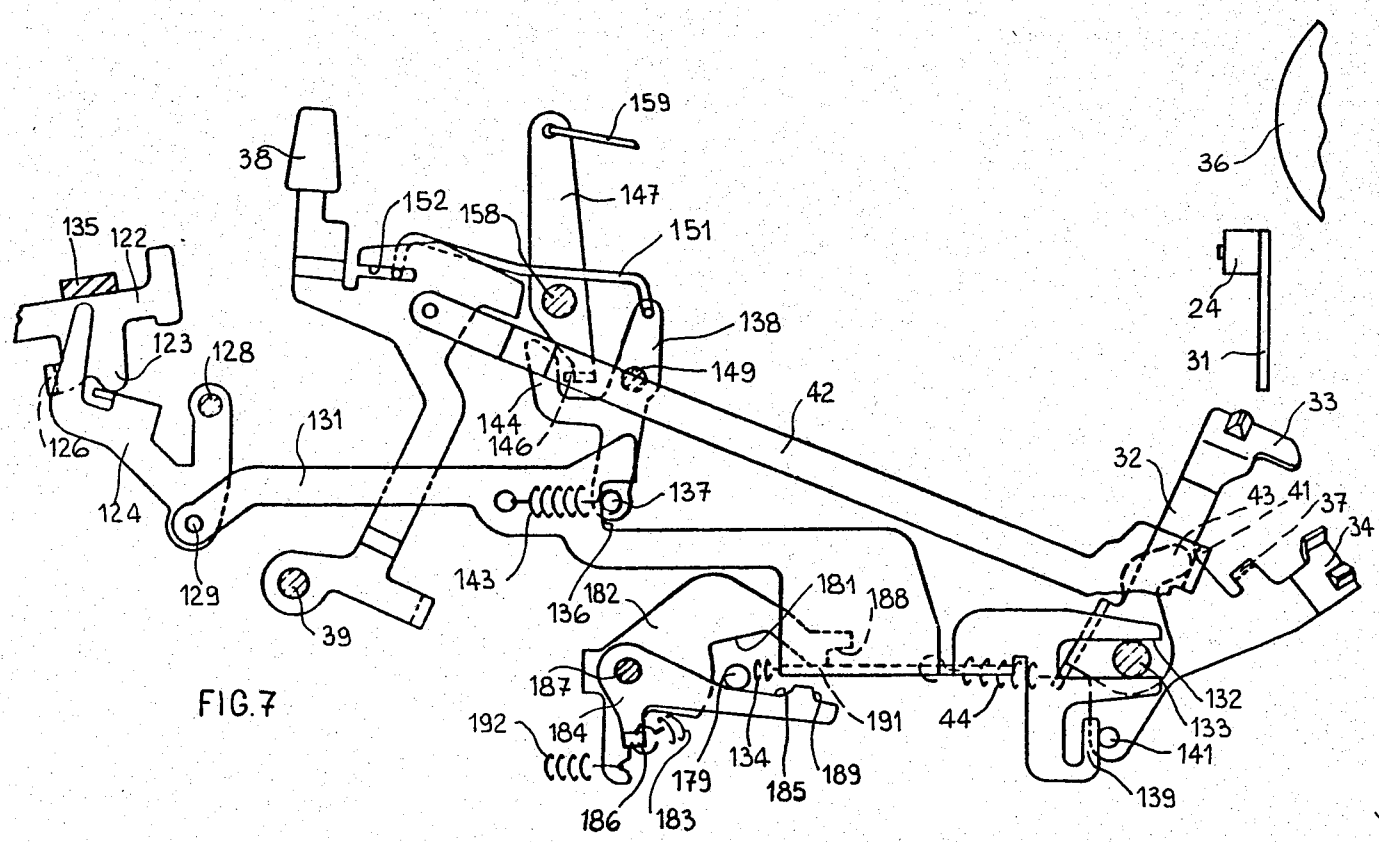
FIG. 7 is a partial longitudinal view of the correction device of FIG. 1.
Figure 8:
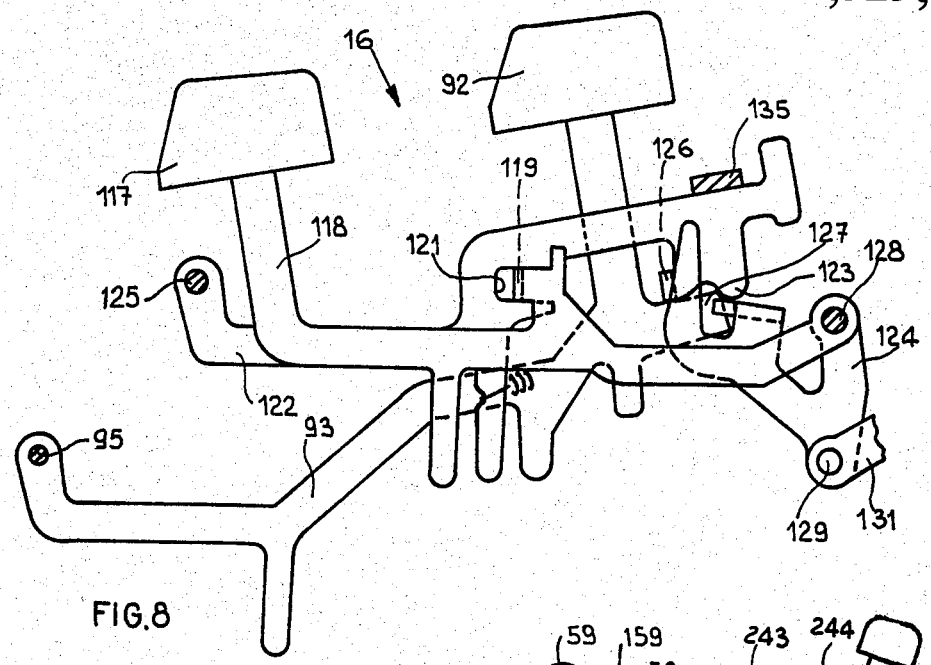
FIG. 8 is a partial longitudinal view of some details of the device of FIG. 1 to an enlarged scale.

The take-up spool 221 is mounted on a toothed wheel 232 of the correction ribbon feed mechanism 161, which comprises a plate 233 rotatable about the axis of the take-up spool 221 and connected by means of the tie rod 159 to the control lever 147 (FIG. 7). The tooth 234 (FIG. 1) is pivoted on the plate 233, and under the action of a spring 236 is normally engaged with a tooth of the wheel 232, while a spring 237 engages a space between two teeth of the wheel 232 and acts as a back-running stop. A spring 238 pivoted on the ribbon guide pin 216 cooperates tangentially with the teeth of the wheel 213 to urge this latter to rotate clockwise together with the feed spool 212, in order to keep the correcting ribbon 211 constantly taut.

For normal typewriter operation, the selector 38 (FIG. 7) is disposed in the typing position, in which it positions the selection lever 32 for the shorter raising stroke of the lever 24, so as to bring the higher track 27 of the ribbon 26 to the point of typing.

The operation of the correction device 16 (FIG. 1) is described by way of example with reference to a case in which the operator shoulder have written the word "ITALIA" but instead has written "ITALIO". At this point, the platen 36 is shifted forward through one space with respect to the last character typed, this being the "O" in the example. By depressing the correcting key 117 (FIG. 8), the operator initiates a correction setting cycle. With its tongue 119, the lever 118 causes the lever 122 to rotate clockwise, this latter, by means of its shoulder 123, causing the operating lever 124 to rotate anticlockwise, and by means of its tongue 126 causing lever 93 to rotate clockwise.

The device 91 carries out a back-spacing cycle in the manner heretofore described, and positions the point of typing in front of the point "O". Rotation of the operating lever 124 causes the slide 131 to move towards the right (FIG. 7). By means of the pin 137, the shoulder 136 causes the hook 138 to rotate anticlockwise, to remove the lug 144 from the trajectory of the tongue 146 of the control lever 147. This has no effect on the selector 38 because of the movement allowed by the slot 152 to the tie rod 151. By means of the pin 141, the tongue 139 causes the selector lever 32 to rotate anticlockwise, to position the shoulder 34 in the trajectory of the tongue 31 of the ribbon raising lever 24 in order to select the correcting ribbon 211. The slide 131, by way of its shoulder 196 (FIG. 10), the return lever 198 and the tie rod 202, causes the disengagement lever 201 to rotate anticlockwise against the action of the springs 206 and 207. The tongue 204 engages the projection 81 and causes the toothed lever 193 to rotate clockwise, so removing the projection 81 from the trajectory of the universal frame 82. By virtue of the spring 192 (FIG. 7), the right hand movement of the slide 131 has also released the first control lever 182, the L shoulder 188 of which becomes disposed in front of the tongue 191 of the slide 131 to prevent the slide 131 from returning to rest when the operator releases the key 117. As described hereinafter, these settings are stored by the slide 131 and lead to the positioning of the shoulder 34 for selecting the correcting ribbon 211, to the release of the hook 138 in order to allow the feed of the correcting ribbon 211, and to the rotation of the toothed lever 193 in order to prevent carriage character spacing.

If the operator now depresses the key corresponding to the mistaken character, in this specific case the key "O", correction cycle is initiated, this differing from a typing cycle involving the hammer 83 with the character "O" only by virtue of the settings made by the key 117. As in the case of every typing cycle, the cam 18 is rotated through 180° per cycle, for example in the manner described in U.S. Pat. No. 3,664,478. By way of the cam follower lever 19 and tie bar 62, the rotation of the cam 18 (FIG. 3) initially causes an anticlockwise rotation of the angle lever 58 and the idle movement of the pawl 54. The lever 19 simultaneously releases the rocker arm 21. The spring 22 now causes it to rotate clockwise and, by means of the tie rod 23, raises the ribbon raising lever 24 until it stops with the tongue 31 against the lowest shoulder 34, to position the correcting ribbon 211 in front of the platen 36 (FIG. 1) at the point of typing.

With the rotation of the angle lever 58 (FIG. 9), the pin 57 causes the lever 163 to rotate clockwise by means of the fork 164. By means of the tongue 168 and spring 162, the control lever 147 is now rotated clockwise and, by way of the tie rod 159, causes the plate 233 (FIG. 1) and tooth 234 to rotate anticlockwise without any effect on the wheel 232 or take-up spool 221, which remain at rest under the action of the spring 237.

By virtue of the anticlockwise rotation of the cam follower lever 19 (FIG. 9), the pin 179 releases the second lever 184. The spring 183 causes the lever 184 to rotate, to move the L shoulder 189 in front of the slide 131, and halt against said slide 131. Furthermore, by engaging the shoulder 181, the pin 179 causes the first lever 182 to rotate anticlockwise, so disengaging the L shoulder 188 from the tongue 191 of the slide 131. The L shoulder 188, disposed more forward than the L shoulder 189, enables the slide 131 to move towards the left in FIG. 9 under the action of its spring 134 (FIG. 10), until it is halted by its tongue 191 (FIG. 9) resting against the L shoulder 189, while the spring 192 (FIG. 7) causes the first lever 182 to rest by way of the edge of the L shoulder 188 on the tongue 191.

During its movement towards the platen 36 (FIG. 1), the "O" hammer 83 (FIG. 4) moves both the typing ribbon 26 and the correcting ribbon 211, but it is in fact the ribbon 211 which strikes against the platen 36. By virtue of this striking action, the correcting ribbon 211 erases or covers the previously typed character, in this example, the "O". During this stage, the universal frame 82 (FIG. 4) does not encounter the projection 81 of the lever 193, and thus is not able to rock the frame 72 to operate the escapement device 71 (FIG. 5).

The subsequent clockwise rotation of the cam follower lever 19 (FIG. 3) caused by the spring 64 and allowed by the cam 18 causes the second lever 184 to rotate clockwise by means of the pin 179 and shoulder 185 (FIG. 9), so disengaging the L shoulder 189 from the tongue 191. The spring 134 (FIG. 7) returns the slide 131 to rest, the spring 143 returns the lug 144 into the trajectory of the tongue 146, and the spring 44 returns the selection lever 32 into a position in which it is halted by virtue of its shoulder 43 acting against the tongue 41 of the tie bar 42. Simultaneously, the springs 206 (FIG. 10) and 207 return the respective levers 198 and 201 to rest, to enable the spring 205 to return the toothed lever 193 into a position in which its shoulder 195 is against the pin 200. In this manner, the settings for the selection and feed of the correcting ribbon 211 and for the locking of the escapement device 71 are nullified. During this stage, the typing ribbon 26 advances. Furthermore, the tie rod 159 (FIG. 1) rotates the plate 233, and by means of the tooth 234 causes the wheel 232 and spool 221 to rotate, so feeding the correcting ribbon 211 through the amount which has been used in correcting the character. The feed spool 212 and wheel 213 rotate anticlockwise to move the spring 238 towards the outside of the wheel 213, until it loses its engagement with one tooth, and re-engages with the next tooth so always keeping the correcting ribbon 211 taut.

The operator can now depress the key corresponding to the correct character to be written, in this example the "A". On initiating a normal typing cycle, the cam 18 (FIG. 2) controls both the device 17 and the device 53 as heretofore described. The tongue 31 halted against the shoulder 33 positions the high part 27 against the point of typing. The fact that the lever 147 halts against the lug 144 (FIG. 7) prevents advancement of the correcting ribbon 161, while the lost motion connection between the tie rod 151 and slot 152 prevents reaction on the selector 38. When the character "A" has been struck, the universal frame 82 can engage the toothed lever 81 and operate the escapement mechanism 71 (FIG. 5) in order to move the platen 36 forward through one character space.

If one or more words are to be erased, a forward correction mode of the typewriter may be selected which avoids the correction key 117 being operated for each character of the word first to be erased. To this end it is sufficient to position the printing point in front of the character to be erased by operating the back-space key 92. The forward correction mode is selected by manually moving the selector 38 forwardly into a correcting position. By means of the tie bar 42, tongue 41 and shoulder 43, the selector 38 rotates anticlockwise the lever 32 to bring the shoulder 34 in front of the tongue 31 against the action of the spring 44. By means of the end of the slot 152 and tie rod 151, the selector 38 rotates anticlockwise the hook 138 against the action of the spring 143 to release the lug 144 from the tongue 146. The spring 50 (FIG. 2) holds the end 49 engaged with the selected slot 48. The action of the spring 50 prevails over the action of the springs 44 (FIG. 7) and 143, the selector 38 is in the correction position and the typewriter remains set for selecting and feeding the correcting ribbon 211. The device 17 (FIG. 2) now selects the correcting ribbon 211, to enable the hammers 83 (FIG. 4) of the mistaken characters to be operated in succession in order to erase the typed characters. However, as the slide 131 (FIG. 10) has not been set, the toothed lever 193 is now at rest, and the universal frame 82 (FIG. 4) can operate the escapement mechanism 71 (FIG. 5) at each strike. No action is exercised on the levers 32 and the hook 138 which remain in their set positions for allowing the erase of the word jointly to the forward movement of the rack 79. After erasing, by returning the selector 38 into the original position of FIG. 7, normal conditions for the lever 32 and hook 138 are restored, and the erased line can be retyped.

To facilitate the insertion of the ribbons 26 and 211 into the fork 29 (FIG. 2), the selector 38 is moved into the correcting position and a further lever 241 (FIG. 9) is manually moved forwardly into an insertion position. The inclined surface 243 of the lever 241 (FIG. 9) then raises the pin 61 and houses it in a seat 244, so raising the lever 24 to the maximum extent for the time necessary for insertion.

What is claim is:

1. A typewriter having a platen defining a printing point on a printing line; a plurality of selectable characters; striking means operable to strike a selected character on the printing point; a forward-space mechanism responsive to the operation of the striking means for forwardly spacing the printing point along the printing line; a back-space mechanism actuatable for back-spacing the printing point; a correcting device for correcting erroneous characters already printed and comprising a correcting ribbon for erasing an erroneous character by a strikeover retyping the character through the interposition of the correcting ribbon between the striking character and the printing point; a typing ribbon; a raising device comprising a single fork for housing, guiding and raising the typing ribbon and the correcting ribbon in front of the printing point; a correction control member settable on a correction position for cooperating with the raising device; correction selection means for selecting either a backward correction mode wherein a previous backspacing of the printing point is required to erase each erroneous character and a forward correction mode wherein the erroneous characters are erased jointly with forward movements of the printing point; said correction selection means comprising a correcting key operable to select the backward correction mode by actuating the back-space mechanism to back-space the printing point in front of the erroneous character, an intermediate element for connecting the correcting key with said correction control member and movable between a rest position to a working position during the backward correction mode, a mechanism actuatable by said intermediate element for inhibiting the operation of the forward-space mechanism during the backward correction mode, a feed device for feeding the correcting ribbon, hook means actuatable by said intermediate element for releasing said correcting ribbon feed device during the backward correction mode, a first control lever and a second control lever each having an L shoulder arranged for holding selectively said intermediate element in said working position and cam means cooperating selectively with said first control lever and said second control lever for releasing said intermediate element when the erroneous character has been erased.

2. A typewriter having a platen defining a printing point on a printing line; a plurality of selectable characters; striking means operable to strike a selected character on the printing point; a forward-space mechanism responsive to the operation of the striking means for forwardly spacing the printing point along the printing line; a back-space mechanism actuatable for back-spacing the printing point; a correcting device for correcting erroneous characters already printed and comprising a correcting ribbon for erasing an erroneous character by a strikeover retyping the character through the interposition of the correcting ribbon between the striking character and the printing point; a typing ribbon; a feed device for feeding the typing ribbon; a raising device comprising a single fork for housing, guiding and raising the typing ribbon and the correcting ribbon in front of the printing point; a correction control member settable on a correction position for cooperating with the raising device; correction selection means for selecting either a backward correction mode wherein a previous back-spacing of the printing point is required to erase each erroneous character and a forward correction mode wherein the erroneous characters are erased jointly with forward movements of the printing point, said correction selection means comprising a correcting key operable to select the backward correction mode by actuating the back-space mechanism to back-space the printing point in front of the erroneous character, an intermediate element for connecting the correcting key with said correction control member and movable between a rest position to a working position during the backward correction mode, and a mechanism actuatable by said intermediate element for inhibiting the operation of the forward-space mechanism during the backward correction mode; a feed device for feeding the correcting ribbon, wherein said feed device for feeding the correcting ribbon feed device is connected through a first spring to the typing ribbon feed device; and hook means cooperative with said intermediate element for releasing said correcting ribbon feed device, wherein said hook means comprise a pin for cooperating with said intermediate element, and a second spring for holding the pin arrested against said intermediate element and wherein said intermediate element moves said hook means for releasing said correcting ribbon feed device against the action of the second spring during the backward correctin mode of the typewriter.

* * * * *